US005485862A

United States Patent [19]

Kahn

[11] Patent Number: 5,485,862

[45] **Date of Patent: * Jan. 23, 1996**

[54] CANE TIP

[76] Inventor: Melvin Kahn, 467 Central Ave., Alameda, Calif. 94501

[ * ] Notice: The portion of the term of this patent subsequent to Jul. 2, 2013, has been disclaimed.

[21] Appl. No.: 224,855

[22] Filed: Apr. 8, 1994

Related U.S. Application Data

[63] Continuation-in-part of Ser. No. 86,613, Jul. 2, 1993, Pat. No. 5,301,703.

[51] Int. Cl.[6] ..... A45B 9/04

[52] U.S. Cl. ..... 135/77; 135/84; 135/911

[58] Field of Search ..... 135/77, 82, 84, 135/85, 911, 65

[56] References Cited

U.S. PATENT DOCUMENTS

| | | | |
|---|---|---|---|
| 2,192,040 | 2/1940 | Harris | 135/77 |
| 3,199,819 | 8/1965 | Widmark | 135/77 X |
| 3,467,117 | 9/1969 | Lucibello | 135/77 X |
| 4,958,651 | 9/1990 | Najm | 135/82 |
| 5,301,703 | 4/1994 | Kahn | 135/911 X |

FOREIGN PATENT DOCUMENTS

| | | | |
|---|---|---|---|
| 22171 | of 1913 | United Kingdom | 135/77 |

*Primary Examiner*—Lanna Mai
*Attorney, Agent, or Firm*—Donald L. Beeson

[57] ABSTRACT

A cane for use by a visually handicapped person which has a tip at its bottom end which has a relatively broad outwardly facing convex contact surface. When slid along the ground as the person walks, the cane tip, which is preferably a hollow shell, provides auditory and kinesthetic clues about the environment and any impediments in the path of the user, yet cannot get caught, stuck or hung up on any obstacles.

4 Claims, 3 Drawing Sheets

CANE TIP

CROSS-REFERENCE TO RELATED APPLICATIONS

This is a continuation-in-part of application Ser. No. 08/086,613 filed Jul.2, 1993, now U.S. Pat. No. 5,301,703.

BACKGROUND OF THE INVENTION

This invention relates to canes used by the visually impaired, and specifically to an improved cane tip which permits greater awareness of obstacles and impediments in the path of the user.

A blind or visually handicapped person walks with a cane for the purpose of sensing that an obstacle or other form of hinderance or dangerous condition is imminent. The user swings the cane in an are from side to side. If the are is sufficiently wide-at least the width of the user's body-the cane will encounter an obstacle prior to its being hit by the person's body, thus allowing the person to stop or otherwise deal with the encounter. The cane is also tapped against the around, normally at the end of the arc of each swing.

The tapping is supposed to inform the traveler of the kind of terrain being traversed and to find any depressions or rises in the surface, such as holes or pits or steps that could cause the visually impaired person to fall. The cane has to be tapped and then immediately raised above the surface being walked upon, lest the cane get caught, stuck or hung up on an obstacle. Thus, the user makes a quick tap at the end of each arc and the arc is made high enough to bring the cane above the surface or walking media until it comes down on the other side where it is likewise tapped again and then returned to the opposite side. This procedure is repeated until the person stops walking. Objects not falling within the tapping range of the cane are not detected. E.g., puddles, holes in the ground, and objects directly in the path of the user, which are large enough to trip over, but not large enough to be detected by the cape in its arc will not be detected. In the tap and swing technique, the cane is travelling through the air in its arc from side to sidle most of the time. This means that the terrain itself is not continuously sampled. Since the cane tip remains above the surface, the flow of information is not constant or immediately discernable with every change in terrain.

Prior canes used tips of various forms including wheels and rollers to improve their usefulness. None of the devices are well adapted for use on a variety of surfaces, from city pavements, to grassy areas, to uneven surfaces. These tips could still be caught in cracks in pavement, or in other obstacles they might encounter as they are swung from side to side.

Wheel or roller tips are meant to be used with constant contact with the surface being walked upon, and hence do not allow the user to have awareness laterally before him or her during walking, since the device is merely pushed forward. They are easily hung up and are suddenly stopped by cracks or larger holes in the surface as well as by vegetation on or to the sides of the walkway. "Wheel" canes must have a fairly smooth and continuous surface. Gravel, earth, sand, brick, cobblestones, etc., are not conducive to the use of a wheel or roller.

The invention provides an improved cane for use by the visually handicapped, and more specifically provides a cane tip having a shape which allows the user to maintain continuous contact with the ground as the cane is moved from side to side. The invention provides a cane whose tip allows the user to avoid entanglement with most objects or crevices in its path and allows the visually impaired to walk in most terrains. It also permits the user to receive kinesthetic clues through the vibration of the cane as the cane traverses the terrain and to receive auditory clues as the tip produces acoustic vibrations that are reflected from surrounding objects. The reflected acoustic vibrations produced by the tip will assist the user in detecting objects much in advance of physically contacting them.

Users of traditional canes can quickly learn to use this modified technique.

It is an additional object of the invention to provide a cane which produces a sound as it moves along the ground, thereby to serve as notice to other pedestrians that someone is approaching.

The vibration running from the tip of the cane through the shaft and into the hand of the user makes the cane valuable to a deaf-blind person. The constant sensation of knowing by feeling through the hand the nature of the surface gives the deaf-blind user otherwise unknown information and a greater sense of confidence.

Further objects and advantages of the invention will become apparent from a consideration of the ensuing description and accompanying drawings.

SUMMARY OF THE INVENTION

Briefly, the invention provides for a cane and tip therefor wherein the cane tip is comprised of a contact element having an outwardly facing convex surface which preferably is relatively broad in relation to the diameter of the shank of the cane to which it is attached and which has a substantially continuous curvature. Preferably, the contact element is in the form of a shell, suitably a hemispherical or completely spherical shell, having an interior hollow region behind its contact surface which tends to amplify or reinforce acoustic vibrations generated when the shell slides across the walking surface.

DETAILED DESCRIPTION OF THE ILLUSTRATED EMBODIMENT

Figure 1:
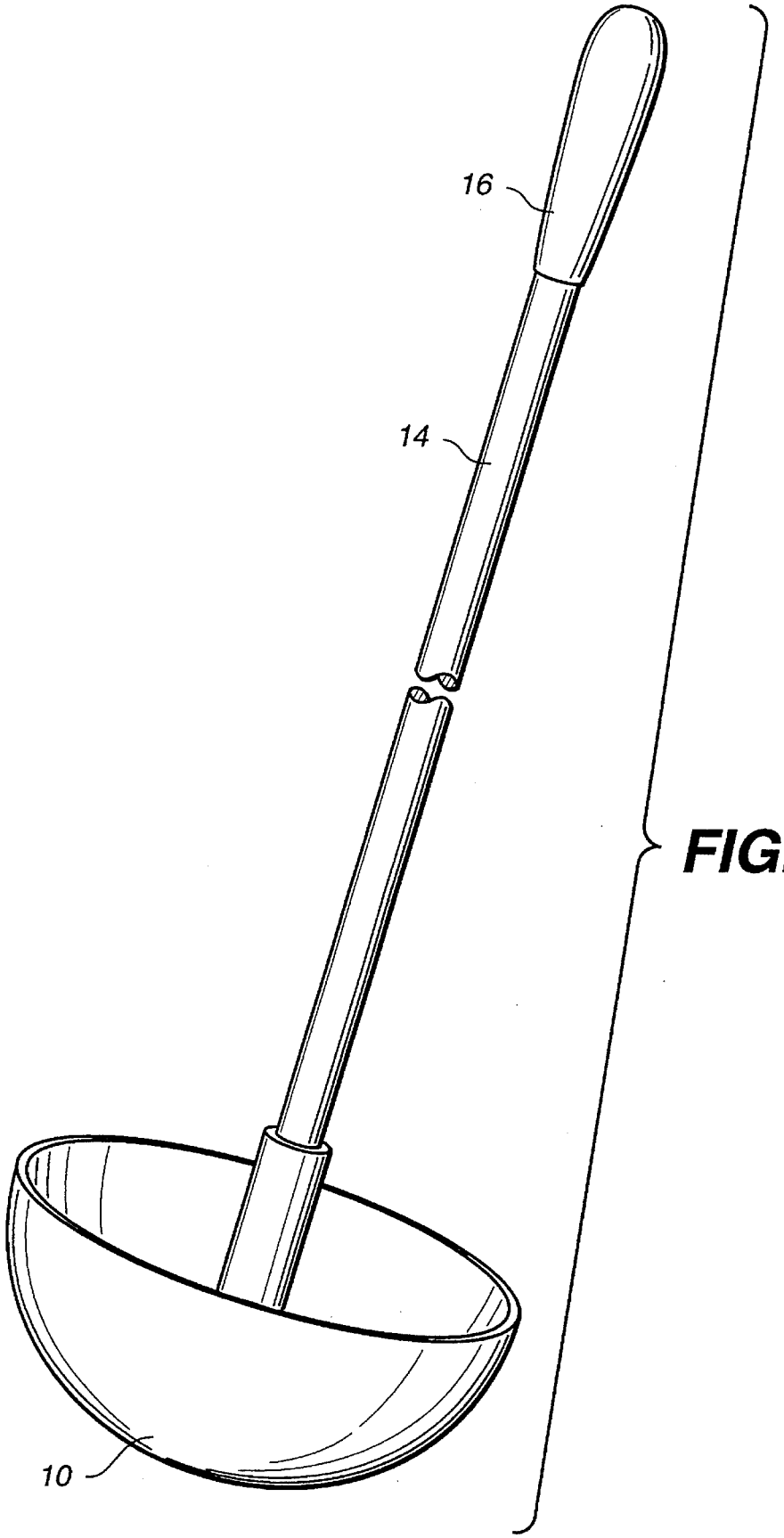
FIG. 1 is a perspective view of a cane with a novel tip according to the invention.
Figure 2:
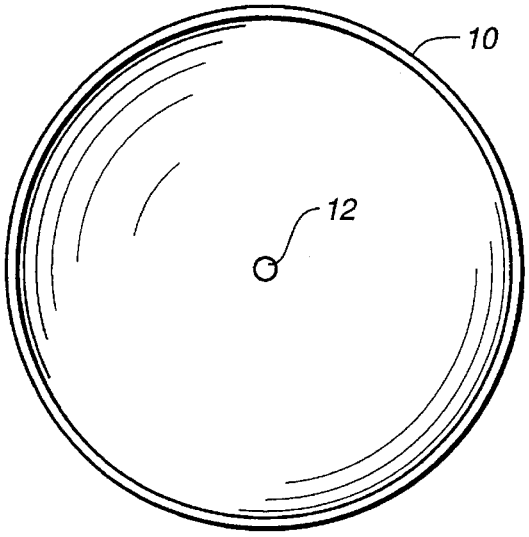
FIG. 2 is a partial side view of the cane of FIG. 1.
Figure 3:
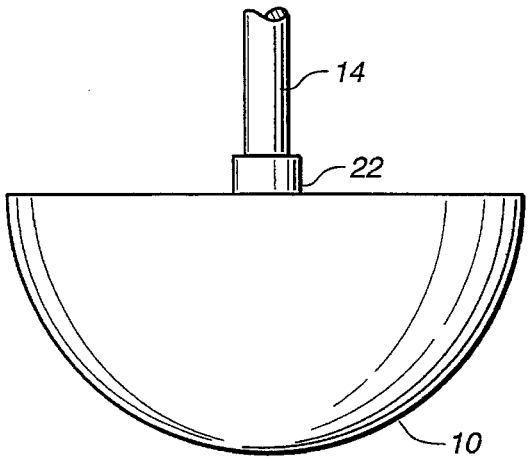
FIG. 3 is a top plan view of the cane shown in FIG. 1.

Referring now to the drawings, FIGS. 1-3 show cane 8 having shank 14 provided with a tip 10 which consists of a contact element which in turn is preferably in the form of a hollow hemispherical contact shell 11 attached by a screw or bolt 12 to the bottom end 15 of the shank. If the shank is hollow, a wooden or plastic plug (not shown) can be inserted into its bottom end 15. FIG. 1 shows the entire length of the shank which has a gripping end 16.

The contact shell 11 is seen to have a relatively large diameter compared to the diameter of the cane's bottom end 15 to which it is attached. It also has an outwardly facing convex contact surface 19 which contacts impediments in the path of the cane as the tip of the cane is moved from side to side over the ground. The convex surface reduces the tendency of the tip of the cane to hang up on objects or impediments; it also creates an internal hollow region 21 behind the contact surface 19 which acts to reinforce the acoustical vibrations produced by the shell 11 when the shell slides across the ground. Reflected sound from the tip can be detected by the user of the cane and makes it easier for the user of the cane to detect what is in front or to the side of him or her, such as buildings, fences, parked automobiles, etc.

Figure 4:
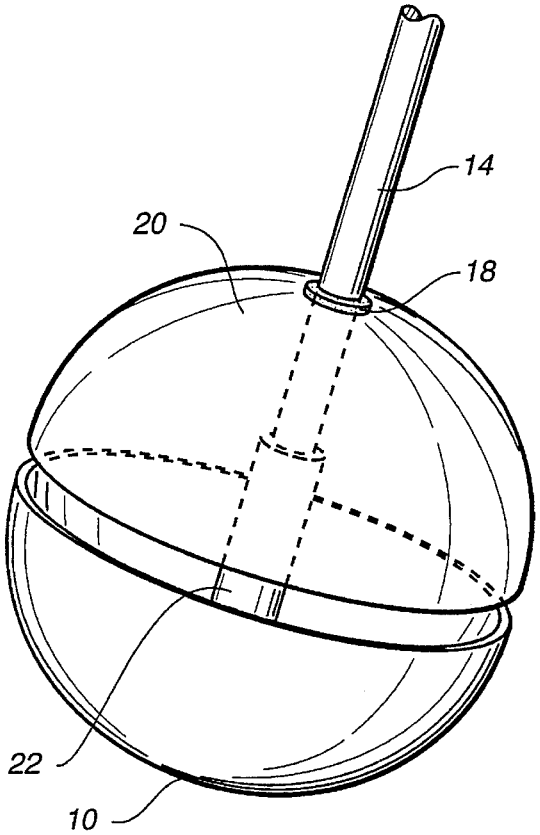
FIG. 4 is a partial perspective view of the cane of the invention showing an alternative embodiment of the cane tip.

FIG. 4 shows an alternative embodiment of the invention wherein a reflector shell 20 is secured to shank 14 by washers 18 in spaced relation above the lower contact shell 11. The washers 18 can be force fit and/or glued to the shank to prevent movement of the reflector shell on the shank. By arranging the two shells 11, 20 so that their interior hollow regions 21, 25 face each other, a reverberation chamber is provided between the shells which enhances the acoustical and kinesthetic qualities of the cane. The spacing between the hemispherical shells should be chosen to give the best acoustic and kinesthetic response. For shells having a 7.5 cm diameter, a spacing, i.e., the width of gap 24, of approximately 2 centimeters is recommended.

Figure 5:
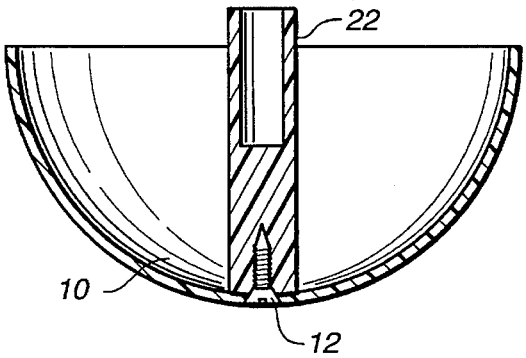
FIG. 5 is a cross-sectional view in side elevation of a cane tip in accordance with the invention showing the use of a nylon sleeve for attachment to the cane.

FIG. 5 shows a cane tip 10 having an insert element 22 attached by screw 26 to the bottom of shell 11. A tip provided with such an insert element, which is suitably a nylon insert, can be readily attached to the bottom end of the shank of a cane.

The material used for the shells 11, 20 may be plastic, fiberglass, or metal. The material should be sturdy and thick enough to resist denting, tearing, etc., in normal, daily use. The diameter of the hemisphere for use on ordinary hard or semi-hard surfaces (pavement, interior flooring or carpeting) is preferably about 7.5 centimeters. This may be varied for special circumstances (uneven unpaved areas) and the diameter adjusted to meet these special circumstances. For example, the diameter may be reduced to 5 centimeters when travel is indoors or on very even surfaces and a compact cane is preferable. The diameter should be as large as 20 centimeters when used on plowed fields, areas planted in rows, e.g., vegetable gardens, orchards, etc. Diameters below 5 centimeters are not recommended since the advantages of the invention would be diminished for tips smaller than this dimension.

The contact surface 19 of the cane tip should also be a smooth continuous surface without edges or ridges that can catch on objects or on crevices or other discontinuities in the ground. By providing a broad smooth contact surface, the cane tip will readily slide over impediments without interfering with the swinging motion of the cane.

Figure 6:
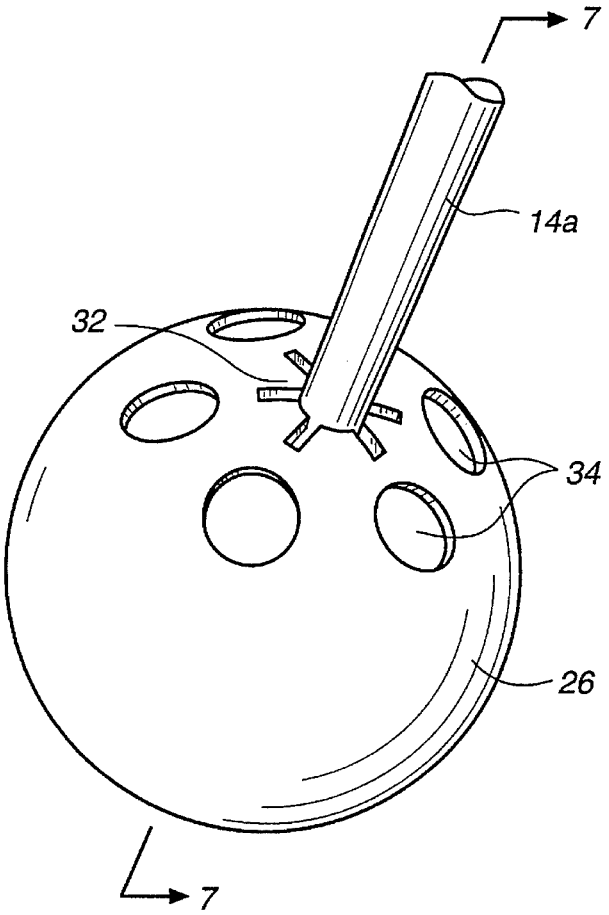
FIG. 6 is a top perspective view of a further embodiment of the a cane tip according to the invention.
Figure 7:
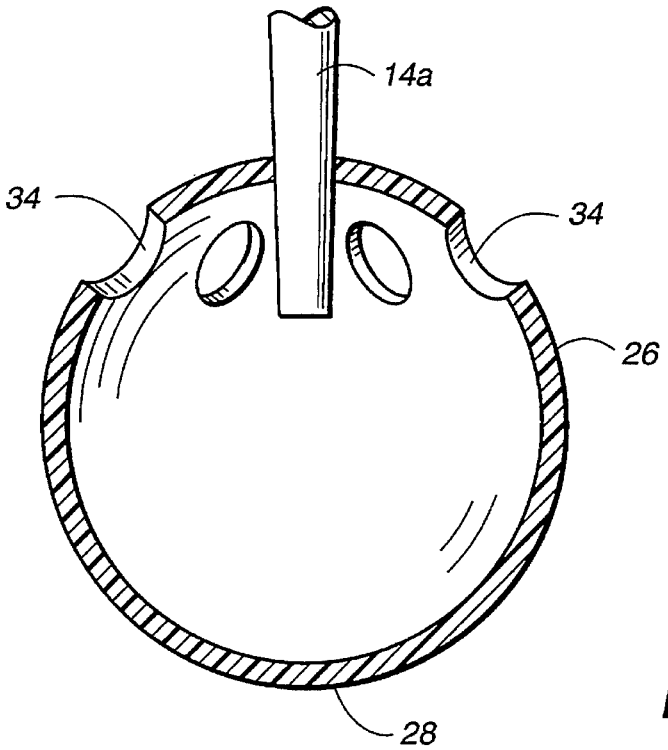
FIG. 7 is cross-sectional side elevational view thereof.

FIGS. 6 and 7 illustrate yet another embodiment of the cane tip of the invention wherein the contact element consists of an enclosed spherical shell 26 having a top side 25 and the bottom side 28 of which forms the outwardly facing convex contact surface of the tip. Attachment of the shell 26 is achieved by simply force fitting the tapered end 30 of shank **14*a* through slotted opening 32 located at the top side of the shell. To improve its acoustic and kinesthetic qualities, suitably sized and shaped reverberation ports or openings 34** can be punched, molded or otherwise formed in the top side of the shell.

It is noted that it is desirable to have some friction between the cane tip and the ground as the cane tip of the invention slides from side to side. To provide this friction on slippery ground surfaces, such as snow or ice, the contact surface of a tip used with such surface conditions can be provided with a gripping contact surface such as an abraded or ridged surface. Ridges would extend radially on the contact surface from the end of the cane shaft so as to have a transverse orientation to the direction of travel of the tip as it slides on the ground.

It shall be understood that while the illustrated cane tip is preferably a hollow hemispherical or spherical shell, the invention is not intended to be limited to a hollow contact element or to a shell that is hemispherical or entirely spherical. The cane tip can suitably be a solid element, such as a solid hemisphere, provided the outwardly facing contact surface provides a continuous smooth curved surface that is relatively broad in relation to the diameter of the shank of the cane to permit the tip to readily negotiate and slide over obstacles in the path of the user. A solid tip, however, would not have all of the acoustic and kinesthetic qualities of a hollow or partially hollow tip and therefore is not a preferred embodiment of the invention. It shall also be understood that the hollow shell version of the tip can be somewhat smaller in relation to the diameter of the shank of the cane and still be effective in view of its acoustical properties. It shall further be understood that the contact element, instead of being attached to the shank of the cane as illustrated, can be manufactured as an integral part of the cane.

OPERATION

The user holds the cane having a tip in accordance with the invention in the customary way, except that instead of tapping and lifting the tip of the cane as the user walks, he or she keeps the tip in continuous contact with the ground by sliding it side to side, preferably at least the width of the user's body, to thereby determine the presence of objects, crevices, etc. in the user's path. Changes in the terrain, curbs, holes and cracks are detected without the risk of the cane becoming entangled or jammed by what it encounters. If the tip is hollow or substantially hollow, the user will receive auditory clues from reflected soundwaves generated by the tip providing additional information on the environment for the user. The sound generated also serves as a warning to other pedestrians that someone is approaching. The deaf blind feel augmented vibrations from the hollow tip, enabling them to determine the conditions in their environment kinesthetically. Blind children will have less difficulty in learning to use a cane tipped with the hollow tip since the coordination is much easier.

Thus, it can be appreciated that the cane tip of the invention provides a safer, easy to use instrument for the visually handicapped and deaf blind which will enable him or her to travel in the sighted world with more confidence and that will open vistas, enabling the user to travel faster and in a wide variety of terrains, e.g., beaches and other sandy areas, plowed fields, grass, gravel, and muddy areas.

As stated, the tip can be manufactured with the cane or sold as a retrofit to replace existing rubber and metal tips. The hemispherical contact shell 11 can be attached in other ways, e.g., by adhesive. It can be made integral with the shank, e.g., by having the shank taper out to the hemisphere, which can be solid or can have a closed upper surface. The hemisphere can be made into a complete sphere as shown in FIGS. 6 and 7 or it can be less than a half-sphere e.g., the bottom third of a sphere. The bottom of the tip, while preferably a portion of a sphere, can also be a portion of any other convex curved figure of revolution, such as a paraboloid, an ovoid, a hyperboloid, a flattened sphere, etc. Accordingly, the reader is requested to determine the scope of the invention by the appended claims and their legal equivalents, and not by the illustrated embodiments.

I claim:

1. A tip for a cane for use by the visually handicapped wherein said cane has a shank and said shank has a bottom end, said tip comprising a contact element including a contact shell having an outwardly facing convex contact surface and a hollow interior region behind said contact surface, said contact surface being relatively broad in relation to the diameter of the bottom end of a shank of a cane to which it is attached, and having a substantially continuous curvature for substantially its entire breath, and said contact element further including a reflector shell having a hollow interior region, said reflector shell being adapted for positioning on the shank of a cane in spaced relation behind said contact shell such that the hollow interior regions of said contact shell and reflector shell face each other to provide a reverberation region between said shells, and means for rigidly attaching said contact element to the bottom end of a shank of a cane such that the contact surface of said contact element acts as a fixed tip of said cane to which it is attached.

2. The cane tip of claim 1 wherein said contact shell and said reflector shell are hemispherical in shape.

3. A cane for use by the visually handicapped comprising a shank having a bottom end and a gripping end, a contact element at the bottom end of said shank, said contact element having an outwardly facing convex contact surface which is relatively broad in relation to the diameter of the bottom end of said shank and which has a substantially continuous curvature for substantially the entire breath of said contact surface, and a reflector shell having a hollow interior region, said reflector shell being secured to said shank behind said contact shell and in spaced relation therewith such that the hollow interior regions of said contact shell and reflector shell face each other to provide a reverberation chamber between said shells.

4. A cane for use by the visually handicapped comprising a shank having a bottom end and a gripping end, a contact element at the bottom end of said shank, said contact element being a substantially spherical ported shell having an outwardly facing convex contact surface which is relatively broad in relation to the diameter of the bottom end of said shank and which has a substantially continuous curvature for substantially the entire breath of said contact surface.

* * * * *

UNITED STATES PATENT AND TRADEMARK OFFICE

CERTIFICATE OF CORRECTION

PATENT NO. : 5,485,862

DATED : January 23, 1996

INVENTOR(S) : Melvin Kahn

It is certified that error appears in the above—identified patent and that said Letters Patent is hereby corrected as shown below:

Col. 1, line 38, "cape" should be --cane--.

Col. 1, line 40, "sidle" should be --side--.

Signed and Sealed this

Ninth Day of April, 1996

Bruce Lehman

*Attest:*

BRUCE LEHMAN

*Attesting Officer*

*Commissioner of Patents and Trademarks*